US006764362B1

(12) United States Patent
Wenzel

(10) Patent No.: US 6,764,362 B1
(45) Date of Patent: Jul. 20, 2004

(54) MONOFIN SWIMMING APPARATUS

(76) Inventor: Clarence Wenzel, 400 Plantation Rd., Huddleston, VA (US) 24104

( * ) Notice: Subject to any disclaimer, the term of this patent is extended or adjusted under 35 U.S.C. 154(b) by 0 days.

(21) Appl. No.: 10/428,417

(22) Filed: May 3, 2003

(51) Int. Cl.[7] ..... A63B 31/08
(52) U.S. Cl. ..... 441/64
(58) Field of Search ..... 441/61–64; D21/239

(56) References Cited

U.S. PATENT DOCUMENTS 2,889,563 A * 6/1959 Lamb et al. ..... 441/64
4,055,174 A * 10/1977 LeVasseur ..... 128/201.11
4,541,810 A * 9/1985 Wenzel ..... 441/64
6,183,327 B1 * 2/2001 Meyer ..... 441/64

* cited by examiner

*Primary Examiner*—Ed Swinehart

(57) ABSTRACT

A swimming apparatus for improved propulsion includes fluked foot flippers constructed to include a stiff load-bearing frame member in the leading edge of the fluke. As the flipper is pumped by the swimmer, a web secured to the frame member is caused to cup the flowing water by arching its surface. The flipper has the general shape of a porpoise tail and provides foot pockets adapted for fitting a variety of foot shapes and configurations.

20 Claims, 5 Drawing Sheets

MONOFIN SWIMMING APPARATUS

BACKGROUND OF THE INVENTION

1. Field of the Invention

The present invention relates to a monofin swimming apparatus. More particularly, the invention relates to flipper type apparatus suitable for wearing on a swimmer's feet. The apparatus of the invention optimizes a swimmer's propulsion resulting from a given movement and allows for wearers with different sized feet or high insteps to fit the swimming apparatus on his feet.

2. Description of the Prior Art

Monofin swimming apparatus suitable for wearing on a swimmer's feet are desirable to optimize a swimmer' propulsion resulting from a given movement and allows for wearers with different sized feet or high insteps to fit the swimming apparatus on his feet.

The uses of monofin swimming apparatus are known in the prior art. For example, U.S. Pat. Nos. 3,934,290 and 4,055,174 to Le Vasseur disclose a swimming system having a single fin for the feet with a large fluke and two foot openings leading to foot pockets separated by a cushion. A series of water directed openings extend rearward and outward from a line above the toe portions of the pockets diagonally through the fluke to a line near a tip of the fluke on a rearward portion of the fin. Holes let water out of foot pockets in the foot-receiving portion. Port openings connect diagonal passageways with lower rearward ports. The foot fluke fin has a laterally extended fluke portion, which tapers outwardly and terminates in a curved distal edge. However, Le Vasseur's patents do not disclose a fin having a load-bearing, resilient frame member of substantially arcuate configuration having two relatively stiff spaced ends and a common connecting portion. This patent does not provide a flipper internal configuration so as to provide maximum propulsion benefit.

U.S. Pat. No. 3,344,449 to Grilli, discloses a swimsuit in the form of a sock or bag of elasticized fabric or cloth having a tubular body tapering from one end to the other, The narrow end of the body of the swimsuit is closed forming a pocket or foot portion for the feet of the wearer. The pocket is formed with spaced perforations at opposite sides. A fin structure is attached to the pocket. The fin structure comprises a triangular-shaped body formed of two sheets to solid rubber, the sheets at the wide portion of the body being juxtaposed and secured together by adhesive and at the upper narrower portion being spaced apart providing a socket portion to receive the foot portion. The upper tapered portion is formed with spaced perforations aligned with the perforations in the foot portion, so that passages are provided across the socket portion of the fin structure. The wide portion of the body is curved at its bottom edge and indented centrally and is formed with curved laterally extending wing portions. However, Grilli's patent does not disclose a load-bearing, resilient frame member of substantially arcuate configuration having two relatively stiff spaced ends and a common connecting portion and does not provide a flipper internal configuration so as to provide maximum propulsion benefit.

Similarly, U.S. Pat. No. 4,781,637 to Caires discloses a transverse fin swimming apparatus that forms a resilient material and twists during swimming. This fin is disclosed in combination with a unitary wet suit. However, Caires' patent does not disclose a fin having a frame member of substantially arcuate configuration having two relatively stiff spaced ends and a common connecting portion and does not provide a flipper internal configuration so as to provide maximum propulsion benefit.

Similarly, U.S. Pat. No. 5,429,536 to Evans discloses a monofin with two-foot pockets that can be positioned on a swim blade for optimal foot position. The blade is v-shaped with upturned outer wing sections that does not provide a fin with a hydrofoil shape and having a frame member of substantially arcuate configuration having two relatively stiff spaced ends and a common connecting portion and does not provide a flipper internal configuration so as to provide maximum propulsion benefit.

Similarly, U.S. Pat. No. Des. 328,118 to Evans discloses a unitary swim fin that provides a monofin with foot pockets. However, Evans' design patent does not provide any structure for the fin and is not in the general shape of a porpoise tail so as to provide maximum propulsion benefit.

U.S. Pat. No. Des. 379,398 to Garraffa et al. discloses a swim fin that provides a monofin with foot pockets. However, Garraffa's patent provides a substantially rectangular flipper and does not provide any structure for the fin and is not in the general shape of a porpoise tail so as to provide maximum propulsion benefit.

U.S. Pat. No. 3,897,509 to Patterman discloses a swimming tail that is formed by a pair of teardrop-shaped flippers located beside each other such that one flipper has an elongated fin projecting from a heal end and the other has an elongated fin projecting from a toe end. However, the swimming tail of Patterman's patent provides two separate flippers with substantially different configurations when worn and does not provide a monofin.

None of the aforementioned patents discloses a monofin with a load-bearing, resilient frame member of substantially arcuate configuration having two relatively stiff spaced ends and a common connecting portion, the frame member being sufficiently flexible to permit bending and twisting in response to an applied load, the substantially flexible, resilient webbing juxtaposed between the end legs and secured thereto, the webbing bowing in response to an applied load, or the foot-receiving pocket in the common connecting portion of the frame member for accommodating both feet of the swimmer of the apparatus of the invention, whereby in operation the apparatus captures a pocket of water in the flexible webbing thereby distorting the shape of the frame member and the webbing and propelling the water rearward in a narrow stream as the swimmer effects upward and downward foot motion.

Although some of the aforementioned references teach the use of a porpoise tail shaped flipper as an aid to aquatic propulsion, none of these patents discloses a flipper internal construction of the type of the invention, which provides maximum propulsive benefit. Since any given shape may be constructed to be rigid or flexible, those skilled in the art have heretofore been left unaided in designing flipper-type apparatus that provides strength and flexibility in the proper regions in order to maximize the propulsion advantages achievable through their use.

U.S. Pat. No. 4,541,810 to Wenzel, herein incorporated by reference discloses a swimming apparatus having a porpoise tail shape that increases a swimmer's speed in the water. This patent provides a monofin device having fluked foot flippers constructed to include a stiff load-bearing frame member in the leading edge of the fluke. As the swimmer pumps the flipper, a web secured to the frame member is caused to cup the flowing water by arching its surface. The flipper permits arching of the web and bending of the frame member both upward and downward, thereby creating a powerful stream of water propelled to the rear and resulting in a powerful propulsive forward thrust of the swimmer. The thrust is further enhanced by applying precisely formed hydrofoil cross-sectional or chordwise shaping to the fluke to accelerate the flow of water into the pocket. This flow also creates a lifting force that is in the direction of the fluke's motion and thus supports the kicking effort. In addition, spanwise hydrodynamic shaping serves to guide a greater volume of water into the pocket thereby further increasing the propulsive thrust.

However, the monofin described in U.S. Pat. No. 4,541,810 does not allow for a single monofin to be fit on a variety of size feet or feet with high insteps. It also makes no provision for having a blunt fluke on the leading edge and a reduced trailing edge to increase the flexibility and decrease the weight of the monofin.

Therefore, a need exists for a new and improved monofin that can be used for increased flexibility and performance and reduced weight as well as provide a foot area to allow the monofin to fit a wider variety of feet sizes and shapes. In this regard, the present invention substantially fulfills this need. In this respect, the monofin according to the present invention substantially departs from the conventional concepts and designs of the prior art, and in doing so provides an apparatus primarily developed for the purpose of aiding a swimmer in optimizes a swimmer's propulsion and allows different sized and shaped feet to fit into the swimming apparatus.

SUMMARY OF THE INVENTION

In view of the foregoing disadvantages inherent in the known types of swimming apparatus now present in the prior art, the present invention provides an improved monofin, and overcomes the above-mentioned disadvantages and drawbacks of the prior art. As such, the general purpose of the present invention, which will be described subsequently in greater detail, is to provide a new and improved monofin which has all the advantages of the prior art mentioned heretofore and many novel features that result in a monofin which is not anticipated, rendered obvious, suggested, or even implied by the prior art, either alone or in any combination thereof.

To attain this, the present invention essentially comprises a monofin having a frame member where the frame member has a leading edge and the foot-receiving pocket is positioned well into the leading edge. The webbing overlays the surface of the frame member to form a continuous coating along the surface of the apparatus. The frame member consists of material of sufficiently compliant properties to permit bending and twisting of the ends as water is captured in the webbing. The ends of the frame member bend upward and toward each other and each of the ends twists essentially about its axis. The frame member has a cross-sectional hydrofoil configuration for providing lift in both kicking directions and for accelerating the flow of water into a pocket formed by bowing action of the webbing in motion. The frame member has a spanwise hydrodynamic configuration for enhancing the entrapment of water and facilitating the flow of water into a pocket formed by bowing action of the webbing in motion and into a concentrated jet stream. The frame member and the webbing consist of material sufficiently resilient to hurl water captured in the webbing rearward to impart a pulse of propulsive force to the swimmer. In accordance with the invention, swimming apparatus for increasing the propulsive thrust of a swimmer comprises a generally Y-shaped frame member of high strength, ductile material having a high resiliency. The frame member has a pair of forked portions spaced from each other at their free ends. Fluked webbing is connected between the forked portions of the frame member. The webbing consists of flexible plastic material that permits bowing between the forked portions when the webbing encounters fluid resistance. A foot-receiving pocket in the frame member at the juncture of the forked portions accommodates both feet of the swimmer. The foot-receiving pocket is encompassed within a housing integrally formed as a portion of the frame member. The housing has a smooth and fluid construction for minimizing hydrofoil drag.

The foot-receiving pocket has a plurality of slots beveled out of the pocket material. Preferably, four slots are provided, with a pair at the top entry point and a pair at the bottom entry point when inserting feet into the foot-receiving pocket.

The flexibility of said member is increased by creating blunt flukes on the leading edge portion of said member and cutting back the trailing edge portion of said member. This increase is an increase compared to the flexibility of a member having flukes as known in the art or as described in U.S. Pat. No. 4,541,810. Optionally, the foot-receiving pockets have toe holes.

In accordance with the invention, swimming apparatus for increasing the propulsive thrust of a swimmer comprises a plastic member formed in the general shape of a porpoise tail having a tail root, a leading edge portion on both sides of the tail root, the leading edge portion having a hydrofoil cross-section, a webbing portion extending between the tail root and leading edge portion, the tail root and leading edge portion consisting of material stiffer than the webbing portion and the webbing portion consisting of material more flexible than that of the tail root and leading edge portion for permitting bowing of the webbing portion and deformation of the leading edge portion as fluid resistance is encountered, and means in the tail root for accommodating both feet of the swimmer. The webbing and leading edge portions are sufficiently resilient to return to their original shape during pumping motion of the feet of the swimmer thereby imparting a rearward velocity to fluid captured in the webbing and a forward thrust to the swimmer.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved monofin that has all of the advantages of the prior art monofins but having reduce weight, increased flexibility, and a better fit and none of the disadvantages.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
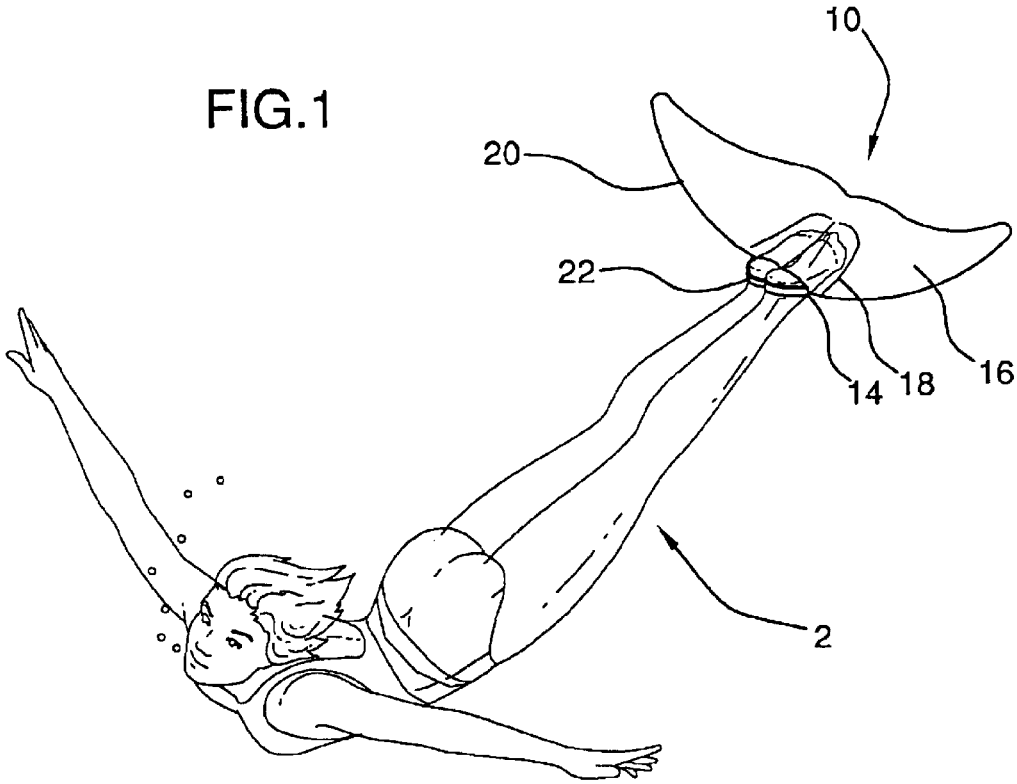
FIG. 1 is a pictorial view of a swimmer wearing the preferred embodiment of the modified monofin constructed in accordance with the principles of the present invention.

Referring now to the drawings, and particularly to FIGS. 1–4, a preferred embodiment of the monofin of the present invention is shown and generally designated by the reference numeral 10. In FIG. 1, a new and improved monofin 10 of the present invention is shown in use. The swimmer 12 is shown wearing the monofin 10 on her feet 14. The monofin 10 allows the swimmer to maneuver the device for increased speed and distance while swimming. The swimming apparatus of the invention comprises a flipper 16 formed in the general shape of a porpoise tail and adapted to accommodate both feet 14 of the swimmer or user 12 snugly within a foot-receiving pocket 18 to permit movement of the flipper 16 in water with good leverage and without the flipper 16 slipping off the feet 14.

Figure 2:
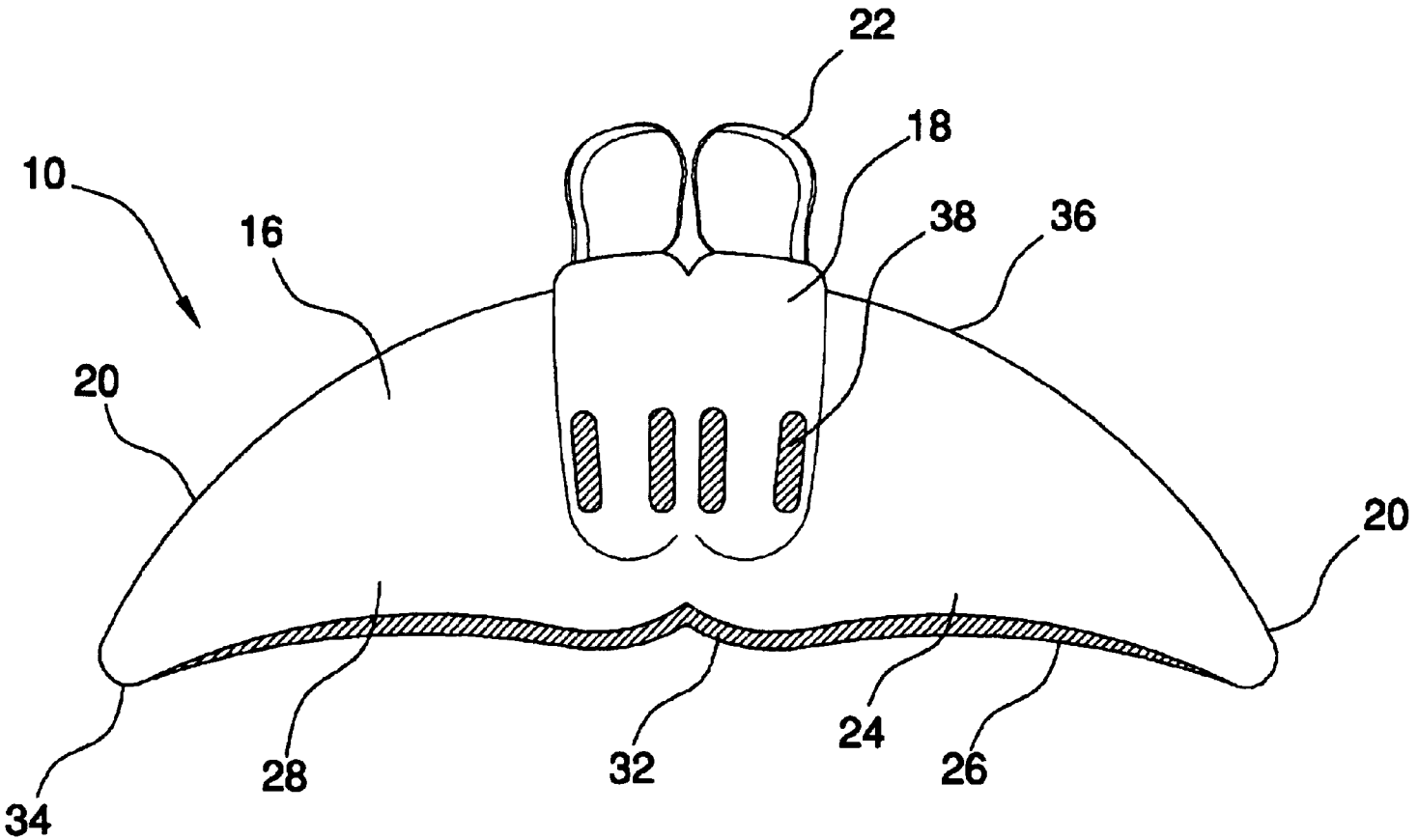
FIG. 2 is a perspective view of the monofin of the present invention.

In FIG. 2, the monofin 10 of the present invention is illustrated and will be described. More particularly, the monofin 10 includes a generally fan-shaped frame, support, or horn member 20 that is generally constructed in an arcuate or wishbone fashion. The frame member 20 provides the basic structural integrity for the flipper. The frame member 20 has a hydrofoil cross-section. Fasteners such as straps 22 may also be used to insure that the user's feet remain securely within the pocket 18 as the wearer pumps his legs. The foot-receiving pocket 18 is positioned well into the leading edge of the flipper 16.

Webbing 24 covers the frame member 20 and is shaped to form the desired fluke pattern at the trailing edge of the webbing 26 between the frame, support, or horn ends 20. The thickness of the webbing 24 is selected to permit sufficient flexibility to effect bowing, arching, ballooning, or cupping of the webbing as the flipper 16 is moved through the water. In use, the webbing material 24 within a flipper fan section 28 encounters sufficient water resistance to force a bowing, arching, ballooning or cupping of the fan between the ends 30 of the more rigid frame member 20. The fluke 32 is displaced by water, causing the fluke to arch and the horn ends 34 to twist With the continuation of the pumping movement, the fan section 28 returns to its normal position and, in fact, will overshoot its normal position to arch, bow, or cup in the opposite direction. The resiliency of the frame member 20 serves to return the frame member to its normal position as the swimmer continues the pumping stroke.

The trailing edge of the webbing 26 in the current invention is cut back as shown in FIG. 2 to reduce the weight of the monofin 10. This cutting alters the shape of the monofin but yet still allows for the hydrofoil design. The shading shown at the trailing edge portion of the webbing 26 demonstrates the area trimmed to create the modified hydrofoil design of the current invention.

Another aspect of the current invention that the leading edge of the monofin 36 has a blunt fluke. This blunt fluke 36 along with the trimmed trailing edge 26 provide a hydrofoil design that has a reduced weight but not reduced performance compared to the monofin design described in U.S. Pat. No. 4,541,810.

The construction of the flipper 16 may be contoured to closely match the profile of the user's feet 14. Alternatively, the profile of the flipper 16 may be less contoured affecting a more forward center of gravity. Molding and finishing requirements are important and play a dominant role in the precise construction selected. Design parameters may vary about the basic requirements for a resilient and flexible fan section 28 which may be cupped, arched, or bowed within a relatively rigid frame member 20.

The foot-receiving pocket 18 has four trimmed slots 38 which are located above the users feet 14 when in use. These slots 38 are located running lengthwise along the foot-receiving pocket 18 and will generally be located where a users little and big toes were against the side of the foot-receiving pocket 18. The pressure on the instep of a foot is reduced by forming a pair of slots at the top entry point of the foot-receiving pocket. Beveling away material at the bottom entry surface of the foot-receiving pocket 18 creates the second pair of slots. The location of the trimmed slots 38 can be adjusted for accommodating the greatest variety in feet size and shape without giving up control of the monofin. Preferably there are four slots at the (top and) bottom entry points for both feet. However, fewer slots could be used or additional slots may be used if desired. Since the trimmed slots 38 ease the pressure focused on the instep of a user's feet 14, this modification is particularly useful for users having high insteps. The slots 38 allow for the user 12 to place his or her feet 14 deeper into the foot-receiving pocket 18 and gain better control and stability of the monofin. The will allow for a more stable fit for a broader range of foot size and shape compared to foot-receiving pockets 18 not having trimmed slots 38.

Figure 3:
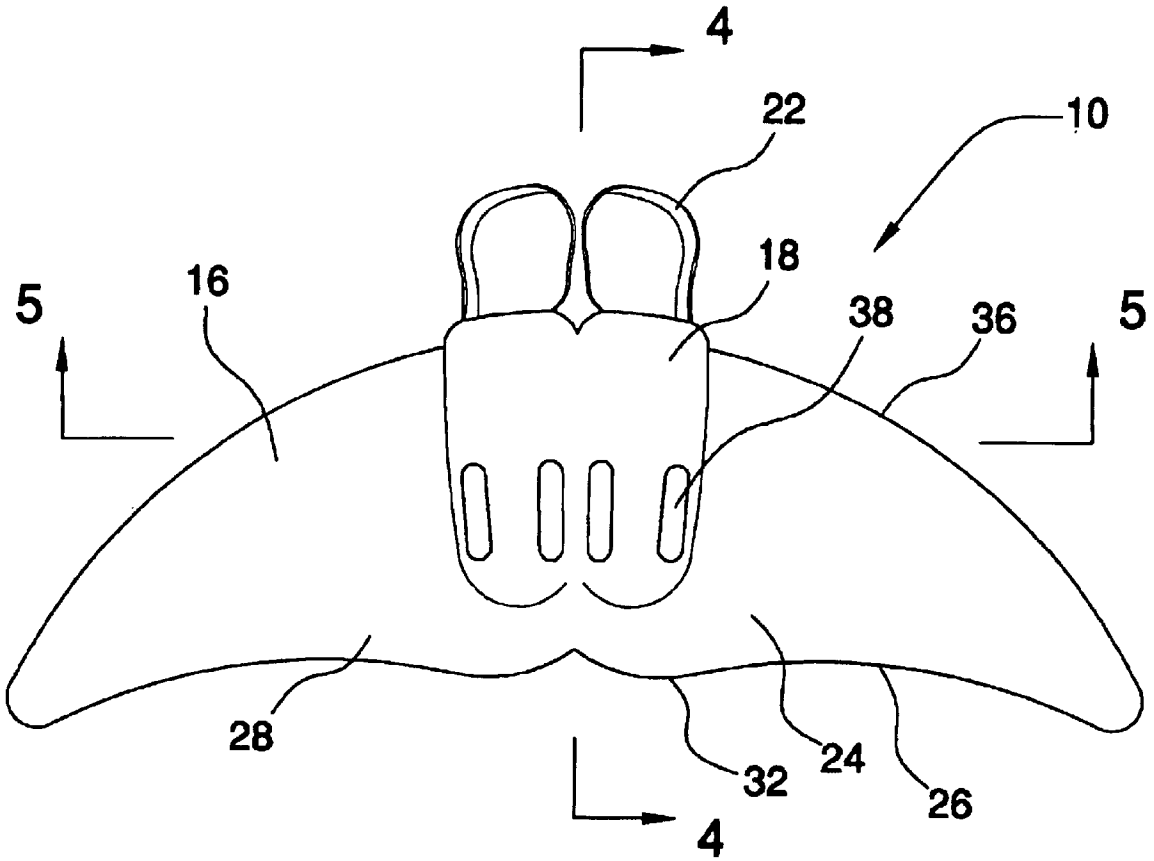
FIG. 3 is a top view of the monofin of the present invention.

FIG. 3 shows a top view of the monofin of the current invention demonstrating the hydrofoil design with the cut-away located at the trailing edge portion 26 of the monofin.

Figure 4:
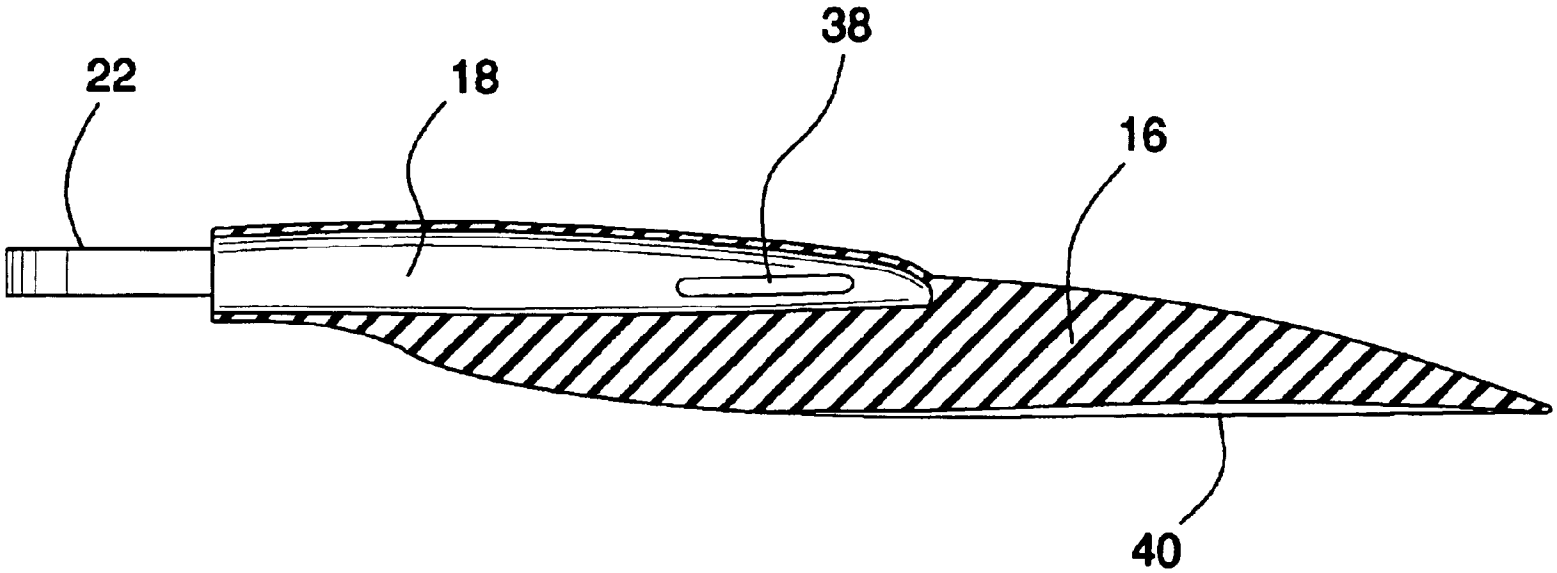
FIG. 4 is a cross-section view of the monofin of the present invention taken along axis 4—4 of FIG. 3.
Figure 5:
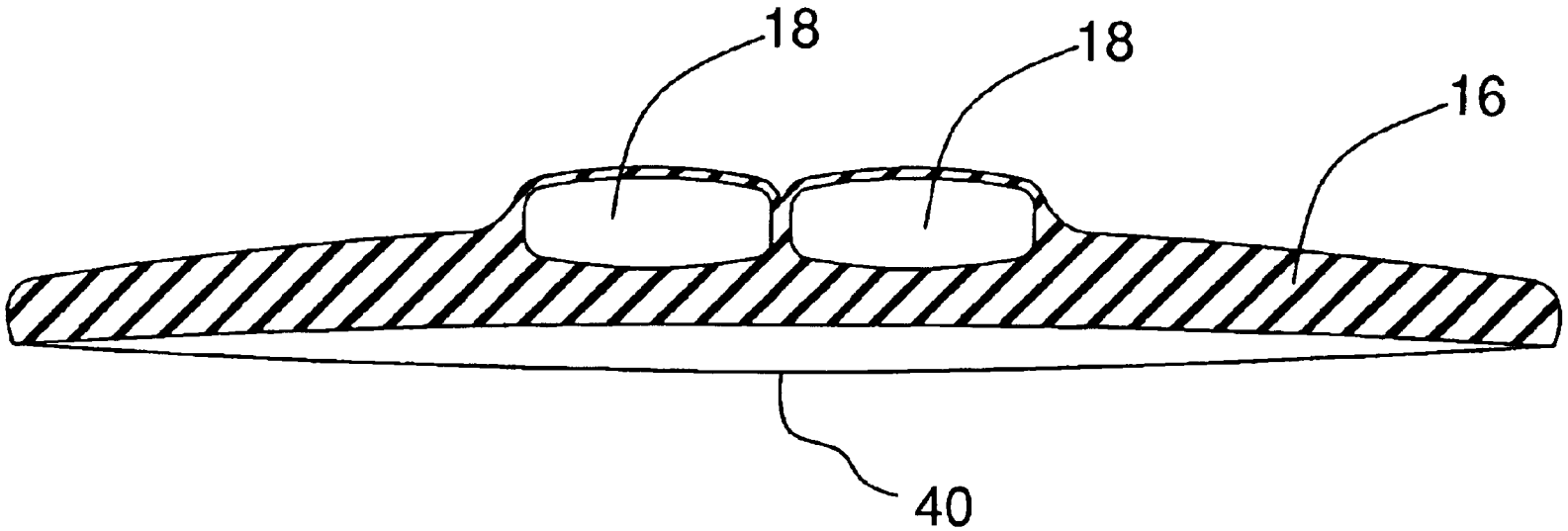
FIG. 5 is a cross-section view of the monofin of the present invention taken along axis 5—5 of FIG. 3.

FIGS. 4 and 5 depict cutaway views; the location of each cut is shown by the numbers and arrows in FIG. 3. The flipper 16 section is shown in relation to the foot-receiving pocket 18 in FIG. 4 with a trimmed slot 36 visible on the edge of the foot-receiving pocket 18. A strap 22 for holding the heel of a foot 14 into the monofin 10 is seen. FIG. 5 shows a horizontal cut-away located in the forward section of the monofin. Two-foot holes depicting the two parts of the foot-receiving pocket 18 are seen in the upper portion of the flipper 16.

There are two competing factors that must be weighted when determining the thickness of the flipper 16 portion of the monofin. A thinner material decreases the weight of the apparatus and thereby increases performance because of the reduced mass that must be maneuvered through the water. Alternatively, thicker materials lend stability and control; if a monofin is too thin it will not be capable of propelling the swimmer through the water as efficiently. It has been found that the thickness of the flipper 16 does not have to be as great as previously required. A thinner monofin 10 can be produced without a loss of efficiency or stability. To reduce the thickness, the underside of the monofin is cut away. The amount of material that can be removed from the porpoise-shaped fin is shown in FIGS. 4–5 by comparing the solid line 40 with the location of the underside of the flipper 16. This reduction in material volume reduces the weight of the monofin of the current invention compared to the monofin described in U.S. Pat. No. 4,541,810. The thinner flipper 16 causes an increased performance due to the reduced weight. However, the maneuverability and stability are not decreased due to cutting away the underside of the monofin 10.

As the user or swimmer 12 pumps his or her feet upward, the fluke 32 is displaced in a downward direction which causes the fluke 32 to arch and the horn ends 34 to twist. Depending upon the direction of the pumping motion, the horn ends 32 may be twisted in a clockwise or counter-clockwise direction essentially about their axes. Inward and upward bending and twisting of the frame member 20 may occur during each pumping motion affected. As the flipper 16 starts down from the high point of its pumping stroke, the frame member 20, due to its design, permits bending both upward and inward while twisting upwards along the inside edge. This flexibility permits the flipper fan section 28 to arch and increases the slingshot effect, imparting increased velocity to the captured water. Thus, the swimming apparatus of the invention traps a body of water within the fan section 28 and, with the proper hydrofoil cross-sectional configuration, propels the water efficiently to the rear.

Cupping, arching or bowing action of the webbing 24 creates a slingshot action of the frame or support member 20 and the webbing that increases the velocity of the water forced to the rear by the flipper action. The forward propulsive thrust or velocity of the swimmer 12 is thereby increased, improving his or her overall swimming efficiency.

In other embodiments, the flipper 16 may include a double slotted fluke construction where a pair of indentations are found in the fluke trailing edge of the flipper assembly. Also, dorsal type fins may extend substantially longitudinally from the flipper. The flipper may include a wide fluke with a trailing edge extending longer than shown in FIG. 2. Alternatively, the flipper may include an extended web length having a fluke trailing edge that is steeper than in the other embodiments, although a more straight edge may be used with the longer web, if desired.

Plastic materials such as blends RP-6414, RP-6405 or Thane (trademark) produced by Smooth-on Corporation are suitable as the webbing material 24. These plastics are preferably injection molded into the desired shape. The frame member 20 may be formed of resilient metallic sheet or tubing material such as, for example, aluminum or spring steel. Holes may be drilled into the frame member 20 to form a better anchor with the plastic material injected about the frame member.

In one embodiment, the material of the frame or horn member 20 is composed of lightweight tapered aluminum tubing construction having a diameter of about one inch at its widest portion. The fan section 28 may be formed of plastic materials such as Ren:C:0-Thane (trademark), produced by Smooth-on Corporation or rubber compounds.

In an alternative embodiment, the need for a separate frame member may be eliminated and the swimming apparatus may be an integral plastic structure. Such structure may assume the aforedescribed shape of the separable frame member 20. Plastic materials such as those hereinbefore described may be injected into a mold to form thicker hydrofoil portions along the leading edge with thinner, more flexible, regions in the webbing area. As one skilled in the art will recognize, there are a variety of techniques and materials that will produce an integral plastic article having varying degrees of flexibility in selected regions.

The objects and advantages of the invention are accomplished by the described flipper construction, which is stiff yet selectively flexible to have a relatively stiff leading edge and a more flexible webbing. The thickness and taper of the webbing may be selected with regard to the particular materials used in the structure and their characteristic flexibility. The material of the frame member should also be somewhat flexible to permit some degree of bending and twisting to permit the webbing to fully arch, bow or cup. For example, spongy ankle socks may be incorporated in the interior of flipper apparatus to soften the interface between the feet of the user and the inner surface of the flipper. Similarly, the foot pockets 18 may be in a generally parallel relation with each other as shown or it may be shaped to accommodate the feet of the swimmer in "pigeon-toed" relation with the toes of both feet closer to each other than the heels of the feet.

While a preferred embodiment of the monofin has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A swimming apparatus for increasing the propulsive thrust of a swimmer comprising:

a member fully encompassed at the foot area of the swimmer, said member having a tail root, forked leg portions joined at said tail root;

a webbing portion extending between said tail root and a trailing edge portion, said forked leg and webbing portions forming a hydrofoil, said tail root and forked leg portions consisting of material stiffer than said webbing portion, said webbing portion consisting of flexible material for permitting bowing and deformation as fluid resistance is encountered;

a plurality of foot-receiving pockets having opposing sides formed through said tail root for accommodating both feet of the swimmer, said webbing and trailing edge portions being sufficiently resilient to return to their original shape during pumping motion of the swimmer's feet thereby imparting a rearward velocity to fluid captured in said webbing and a forward thrust to said swimmer, and said foot-receiving pocket extending into said webbing portion, said member further having a centerline and being formed in the general shape of a porpoise tail, said trailing edge having outer concave portions and inner convex portions symmetrically arranged with respect to the member centerline;

a plurality of slots extending through said opposing sides of said foot-receiving pockets, wherein said slots are aligned with a user's little and big toes;

a plurality of strays having opposing ends with said opposing ends attached to said opposing sides of said foot-receiving pockets-and wherein the flexibility of said member is increased by creating blunt flukes on the leading edge portion of said member and cutting back the trailing edge portion of said member.

2. The swimming apparatus of claim 1, comprising four slots in said foot-receiving pockets.

3. The swimming apparatus of claim 2, wherein said four slots in said foot-receiving pockets are located at the top and bottom entry points of said foot-receiving pockets.

4. The swimming apparatus of claim 2, further comprising holes in said foot-receiving pockets, wherein said holes are located over the toe portion of said foot-receiving pockets.

5. The swimming apparatus of claim 2, wherein said four slots are 1–6 inches long and 0.2–2 inches wide.

6. The swimming apparatus of claim 1, wherein the thickness of said fin is minimized.

7. The swimming apparatus of claim 1, wherein said member is 16–32 inches long and 16–24 inches wide.

8. The swimming apparatus of claim 7, wherein said member is 20–28 inches long and 18–22 inches wide.

9. The swimming apparatus of claim 1, wherein said webbing consists of rubber.

10. The swimming apparatus of claim 1, wherein said webbing consists of a plastic material.

11. The swimming apparatus of claim 1, wherein said member has a cross-sectional hydrofoil configuration for providing lift in both kicking directions of the swimmer's feet.

12. The swimming apparatus of claim 1, wherein said member has a spanwise hydrodynamic configuration for enhancing the entrapment of water and facilitating the flow of water into a pocket formed by bowing action of said webbing in motion and into a concentrated jet stream.

13. A swimming apparatus for increasing the propulsive thrust of a swimmer comprising:

a member fully encompassed at the foot area of the swimmer, said member having a tail root, forked leg portions joined at said tail root;

a webbing portion extending between said tail root and a trailing edge portion, said forked leg and webbing portions forming a hydrofoil, said tail root and forked leg portions consisting of material stiffer than said webbing portion, said webbing portion consisting of flexible material for permitting bowing and deformation as fluid resistance is encountered;

a plurality of foot-receiving pockets having opposing sides formed through said tail root for accommodating both feet of the swimmer, said webbing and trailing edge portions being sufficiently resilient to return to their original shape during pumping motion of the swimmer's feet thereby imparting a rearward velocity to fluid captured in said webbing and a forward thrust to said swimmer, and said foot-receiving pockets extending into said webbing portion, said member further having a centerline and being formed in the general shape of a porpoise tail, said trailing edge having outer concave portions and inner convex portions symmetrically arranged with respect to the member centerline;

wherein said swimming apparatus further comprises four slots extending through said opposing sides of said foot-receiving pockets, wherein said slots are aligned with a user's little and big toes; and a plurality of straps having opposing ends with said opposing ends attached to said opposing sides of said foot-receiving pockets.

14. The swimming apparatus of claim 13, wherein said four slots in said foot-receiving pockets are located at the top and bottom entry points of said foot-receiving pockets.

15. The swimming apparatus of claim 14, further comprising holes in said foot-receiving pockets, wherein said holes are located over the toe portion of said foot-receiving pockets.

16. A swimming apparatus for increasing the propulsive thrust of a swimmer comprising:

a member fully encompassed at the foot area of the swimmer, said member having a tail root and forked leg portions joined at said tail root;

a webbing portion extending between said tail root and a trailing edge portion, said forked leg and webbing portions forming a hydrofoil, said tail root and forked leg portions consisting of material stiffer than said webbing portion, and said webbing portion consisting of flexible material for permitting bowing and deformation as fluid resistance is encountered;

a plurality of foot-receiving pockets formed through said tail root for accommodating both feet of the swimmer, said webbing and trailing edge portions being sufficiently resilient to return to their original shape during pumping motion of the swimmer's feet thereby imparting a rearward velocity to fluid captured in said webbing and a forward thrust to said swimmer, and said foot-receiving pockets extending into said webbing portion, said member further having a centerline and being formed in the general shape of a porpoise tail, said trailing edge having outer concave portions and inner convex portions symmetrically arranged with respect to the member centerline;

a plurality of slots, wherein said opposing sides of said foot-receiving pockets defined a slot therein to comprise said slots, wherein said slots are aligned with a user's little and big toes;

a plurality of straps having opposing ends with said opposing ends attached to said opposing sides of said foot-receiving pockets; and wherein the flexibility of said member is increased by creating blunt flukes on the leading edge portion of said member and cutting back the trailing edge portion of said member.

17. The swimming apparatus of claim 16, wherein said webbing consists of rubber.

18. The swimming apparatus of claim 16, wherein said webbing consists of a plastic material.

19. The swimming apparatus of claim 16, wherein said member has a cross-sectional hydrofoil configuration for providing lift in both kicking directions of the swimmer's feet.

20. The swimming apparatus of claim 17, wherein said member has a spanwise hydrodynamic configuration for enhancing the entrapment of water and facilitating the flow of water into a pocket formed by bowing action of said webbing in motion and into a concentrated jet stream.

* * * * *